US009439542B2

(12) United States Patent
Chen

(10) Patent No.: US 9,439,542 B2
(45) Date of Patent: Sep. 13, 2016

(54) VERTICAL ASSEMBLING AND DISASSEMBLING MECHANISM FOR TOILET SEAT

(71) Applicant: HOTI (XIAMEN) PLUMBING INC., Xiamen (CN)

(72) Inventor: Guobin Chen, Xiamen (CN)

(73) Assignee: HOTI (XIAMEN) PLUMBING INC., Xiamen, Fujian (CN)

( * ) Notice: Subject to any disclaimer, the term of this patent is extended or adjusted under 35 U.S.C. 154(b) by 117 days.

(21) Appl. No.: 14/594,112

(22) Filed: Jan. 10, 2015

(65) Prior Publication Data

US 2015/0265110 A1 Sep. 24, 2015

(30) Foreign Application Priority Data

Mar. 21, 2014 (CN) ..... 2014 1 0106582

(51) Int. Cl.
*A47K 13/12* (2006.01)
*A47K 13/26* (2006.01)

(52) U.S. Cl.
CPC ..... *A47K 13/12* (2013.01); *A47K 13/26* (2013.01)

(58) Field of Classification Search
CPC ..... A47K 13/12; A47K 13/26
USPC ..... 4/236, 240
See application file for complete search history.

(56) References Cited

U.S. PATENT DOCUMENTS

2013/0117919 A1* 5/2013 Peng ..... A47K 13/12 4/236
2013/0333104 A1* 12/2013 Hong ..... A47K 13/12 4/236
2015/0216379 A1* 8/2015 Chen ..... A47K 13/12 4/240

* cited by examiner

*Primary Examiner* — Tuan N Nguyen

(57) ABSTRACT

A vertical assembling and disassembling mechanism for a toilet seat includes a support, a fixing axle, and a turning member. A pin of the support can be inserted into or pulled out a radial pin hole of the fixing axle. The fixing axle includes a damper therein to connect with the turning member. The fixing axle is formed with a lock hole to receive a lock plate biased by a spring. A turning ring is provided to cooperate with the lock plate. The inner end of the lock plate is engaged with the pin. The inner wall of the turning ring is formed with an inverted step recess. When the turning ring is turned about 90±3 degrees, the outer end of the lock plate is engaged in the inverted step recess and the inner end of the lock plate is disengaged from an annular groove of the pin.

10 Claims, 10 Drawing Sheets

VERTICAL ASSEMBLING AND DISASSEMBLING MECHANISM FOR TOILET SEAT

BACKGROUND OF THE INVENTION

1. Field of the Invention

The present invention relates to a connecting mechanism for a toilet seat and a toilet bowl, and more particularly to a vertical assembling and disassembling mechanism for a toilet seat.

2. Description of the Prior Art

A conventional toilet seat comprises a toilet seat cover and a toilet seat ring which are connected through a turning axle. The end of the turning axle is provided with a lock switch. The support of the toilet base is provided with a pin to connect with the lock switch. The pin can be disengaged from the lock switch by pressing a button manually, so that the pin and lock switch are in a separate state, namely, the toilet seat cover is disengaged from the support for cleaning the toilet seat and the toilet seat cover. The assembling and disassembling mechanism between the toilet seat and the toilet base has some problems. It is not convenient and quickly to disassemble the toilet seat cover by pressing the button manually to control the lock. The turning axle to connect the toilet seat cover and the toilet seat ring is composed of a damper and a connecting axle. The turning axle and the damper directly support the toilet seat cover for the toilet seat cover to pivot thereon. The toilet seat cover is mainly supported by the damper. Thus, the turning axle composed of the damper and the connecting axle is bad, and its support strength is weak. The turning axis of the toilet seat cover may be curved, so the toilet seat cover cannot be turned smoothly. Some toilet seat covers are not provided with the damper to control the turning speed of the toilet seat cover. They are controlled by a speed control of a motor. The arrangement of the damper will influence the design of the toilet seat cover. If the damper is not provided, the toilet seat cover cannot be supported so its suitability is limited. Accordingly, the inventor of the present invention has devoted himself based on his many years of practical experiences to solve these problems.

SUMMARY OF THE INVENTION

The primary objective of the present invention is to provide a vertical assembling and disassembling mechanism for a toilet seat. The mechanism can be assembled and disassembled quickly and conveniently, provides strong connection and better suitability.

In order to achieve the aforesaid objective, the vertical assembling and disassembling mechanism for a toilet seat of the present invention comprises a support fixed to a toilet bowl and a fixing axle for a toilet seat axle sleeve to pivot on the fixing axle. A pin on the support is inserted into a radial pin hole of the fixing axle. A turning member is provided for connecting a toilet seat cover axle sleeve with a toilet seat axle sleeve. An axial inner hole of the fixing axle is provided with a damper therein. A damper axle of the damper is exposed out of the axial inner hole to connect with the turning member. The fixing axle is formed with a lock hole intersecting the radial pin hole. A lock plate is slidably connected in lock hole. A spring is provided between the lock plate and the fixing axle. A turning ring linked by the toilet seat is rotatably fitted on the fixing axle. An inner wall of the turning ring slidably holds against an outer end of the lock plate. An inner end of the lock plate is engaged with an annular groove of the pin. The inner wall of the turning ring is formed with a pair of symmetrical inverted step recesses corresponding in position to the pin hole. When the turning ring is turned about 90±3 degrees, the outer end of the lock plate is engaged in the inverted step recess and the inner end of the lock plate is disengaged from the annular groove of the pin.

Preferably, the outer end of the lock plate has a trapezoid protruding platform to mate with the inverted step recess. When the turning ring is turned, the inverted step recess is to press against the trapezoid protruding platform to disengage from the inverted step recess. After the trapezoid protruding platform disengages from the inverted step recess, the inner end of the lock plate is engaged with the annular groove. The trapezoid protruding platform is in contact with the inner wall of the turning ring, such that the lock plate is unable to disengage from the annular groove. The lock plate is to lock the pin in the pin hole, so that the pin cannot be disengaged from the pin hole.

Preferably, the inner end of the lock plate has a curved notch to mate with the annular groove of the pin. When the curved notch is engaged with the annular groove, the lock plate is to lock the annular groove of the pin so that the pin cannot be disengaged from the pin hole.

Preferably, an outer wall of the turning ring is formed with a pair of protrusions to engage with engaging notches formed on an inner wall of the toilet seat axle sleeve. Through engagement of the protrusions and the engaging notches, the turning ring is connected with the toilet seat axle sleeve and can be turned synchronously along with the toilet seat.

Preferably, the fixing axle is further connected with a stop ring for preventing the turning ring from disengagement.

Preferably, the vertical assembling and disassembling mechanism for a toilet seat further comprises a compression spring. The compression spring axially holds against the stop ring for the turning member to be positioned is between the toilet seat cover axle sleeve and the toilet seat axle sleeve. When installed, the turning member is retreated in the toilet seat axle sleeve. When the toilet seat axle sleeve is aligned with the toilet seat cover axle sleeve, the compression spring is to press against the turning member to be inserted into the toilet seat cover axle sleeve. The turning member is quickly connected and positioned in the toilet seat cover axle sleeve and the toilet seat axle sleeve.

Preferably, the compression spring is inserted in the toilet seat axle sleeve and held between the stop ring and the toilet seat axle sleeve, preventing the compression spring from directly pressing against the turning ring to influence the turning of the turning ring.

Preferably, the fixing axle is further formed with an engaging hole which is disposed above the lock hole and communicates with the pin hole. The pin is formed with an annular positioning groove corresponding in position to the engaging hole. An elastic plate is engaged in the engaging hole and positioned in the positioning groove. When the pin is inserted into the pin hole in place, the distal end of the elastic plate is quickly snagged into the annular positioning groove to sound a noise. This means that the pin is inserted in placed.

Preferably, the wall of the positioning groove has a curved surface. When the pin is pulled out of the pin hole, the distal end of the elastic plate is quickly compressed out of the annular positioning groove by the curved surface of the positioning groove.

Preferably, the top end of the pin has an annular inclined surface. When the pin is inserted into the pin hole, the annular inclined surface will guide the pin to be inserted into the pin hole quickly. Besides, the annular inclined surface can press against the distal end of the elastic plate to disengage from the pin hole.

The beneficial effects of the present invention are described hereinafter.

1. The present invention uses the turning member linked by the toilet seat axle sleeve to control engagement or disengagement of the lock plate and the annular groove of the pin. When the toilet seat is turned up about 90±3 degrees, namely, the toilet seat is in a vertical state, the turning ring gives a place to the lock plate and the lock plate is disengaged from the annular groove of the pin to unlock the pin. In this state, the pin can be inserted into or pulled out of the pin hole. Thus, the toilet seat can be disassembled from the toilet bowl quickly. When the toilet seat is turned less than 90±3 degrees, the lock plate is always to limit the turning ring, such that the lock plate is engaged in the annular groove all the time to lock the pin and the pin is unable to be pulled out of the pin hole.

2. The fixing axle and the turning member constitute a pivot to support the toilet seat for the toilet seat cover and the toilet seat to pivot thereon. The damper is provided in the axial inner hole, such that the distance between the force bearing point to support the toilet seat cover and the toilet seat and the pin is shortened and the strength for the support to support the toilet seat is greater.

3. The damper is secured in the axial inner hole. The damper axle of the damper is exposed out of the axial inner hole to connect with the turning member. The entire strength of the pivot of the toilet seat is greater.

4. Without the damper, the fixing axle and the turning member can support the toilet seat. Therefore, the suitability of the present invention is better.

DETAILED DESCRIPTION OF THE PREFERRED EMBODIMENTS

Embodiments of the present invention will now be described, by way of example only, with reference to the accompanying drawings.

Figure 4:
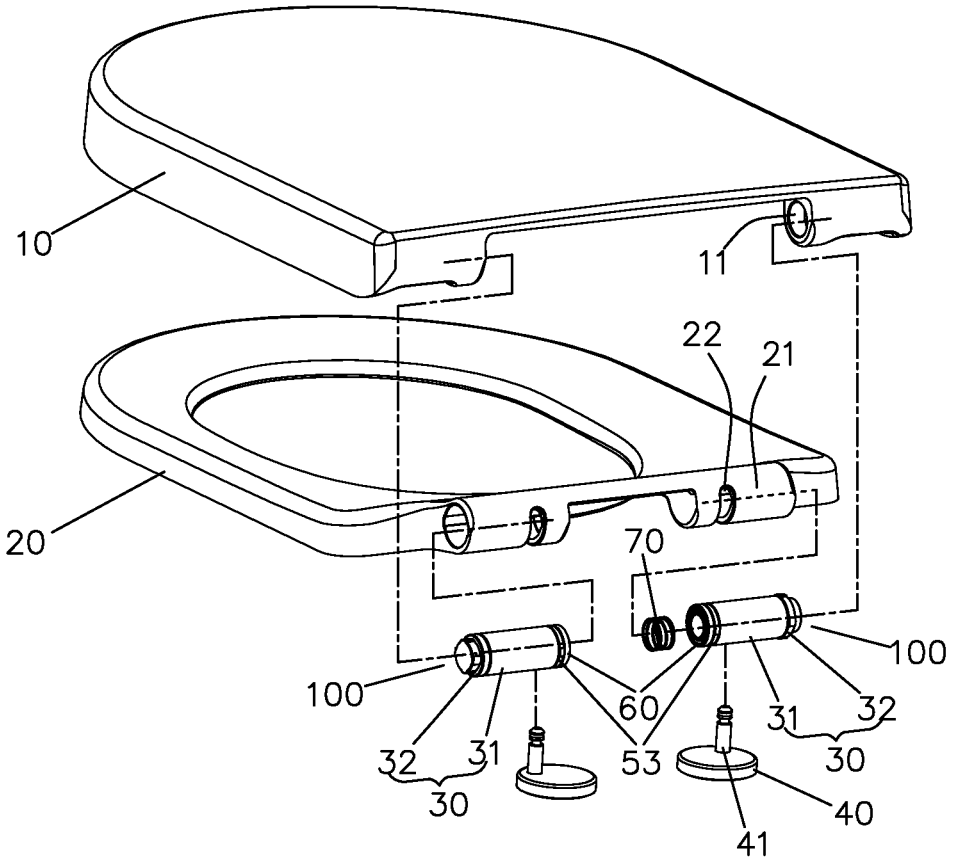
FIG. 4 is an exploded view showing the toilet seat mounted with the present invention.
Figure 5:
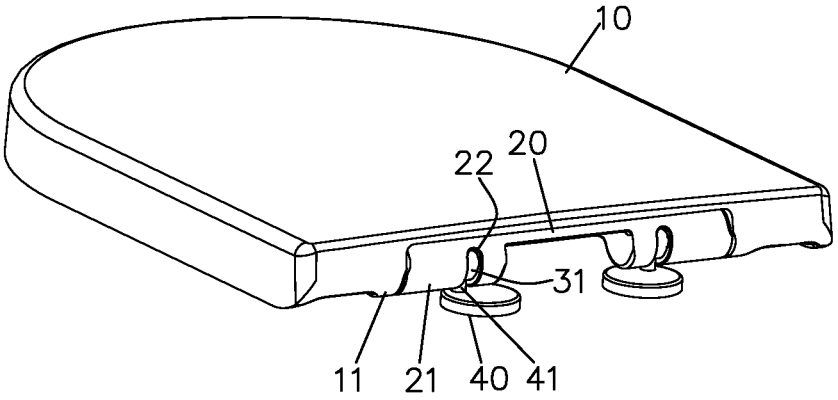
FIG. 5 is a perspective view showing the toilet seat mounted with the present invention.
Figure 6:
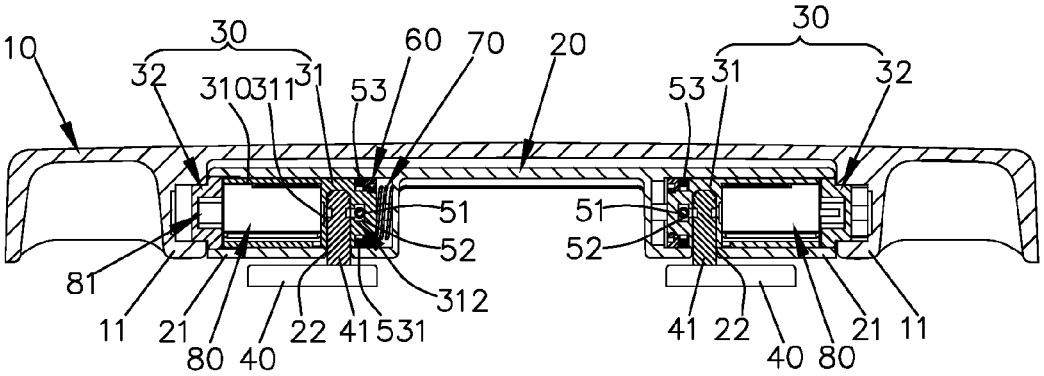
FIG. 6 is a sectional view showing the toilet seat mounted with the present invention.

As shown in FIG. 4 and FIG. 5, the present invention discloses a vertical assembling and disassembling mechanism for a toilet seat. The present invention comprises a support 40 fixed to a toilet bowl, a fixing axle 31 for a toilet seat axle sleeve 21 to pivot on the fixing axle 31, a turning member 32 for connecting a toilet seat cover axle sleeve 11 with a toilet seat axle sleeve 21. The fixing axle 31 and the turning member 32 from a pivot 30 for supporting the toilet seat cover axle sleeve 11 and the toilet seat axle sleeve 21 to pivot thereon. As shown in FIG. 6, a pin 41 on the support 40 is inserted into a radial pin hole 311 of the fixing axle 31.

Figure 1:
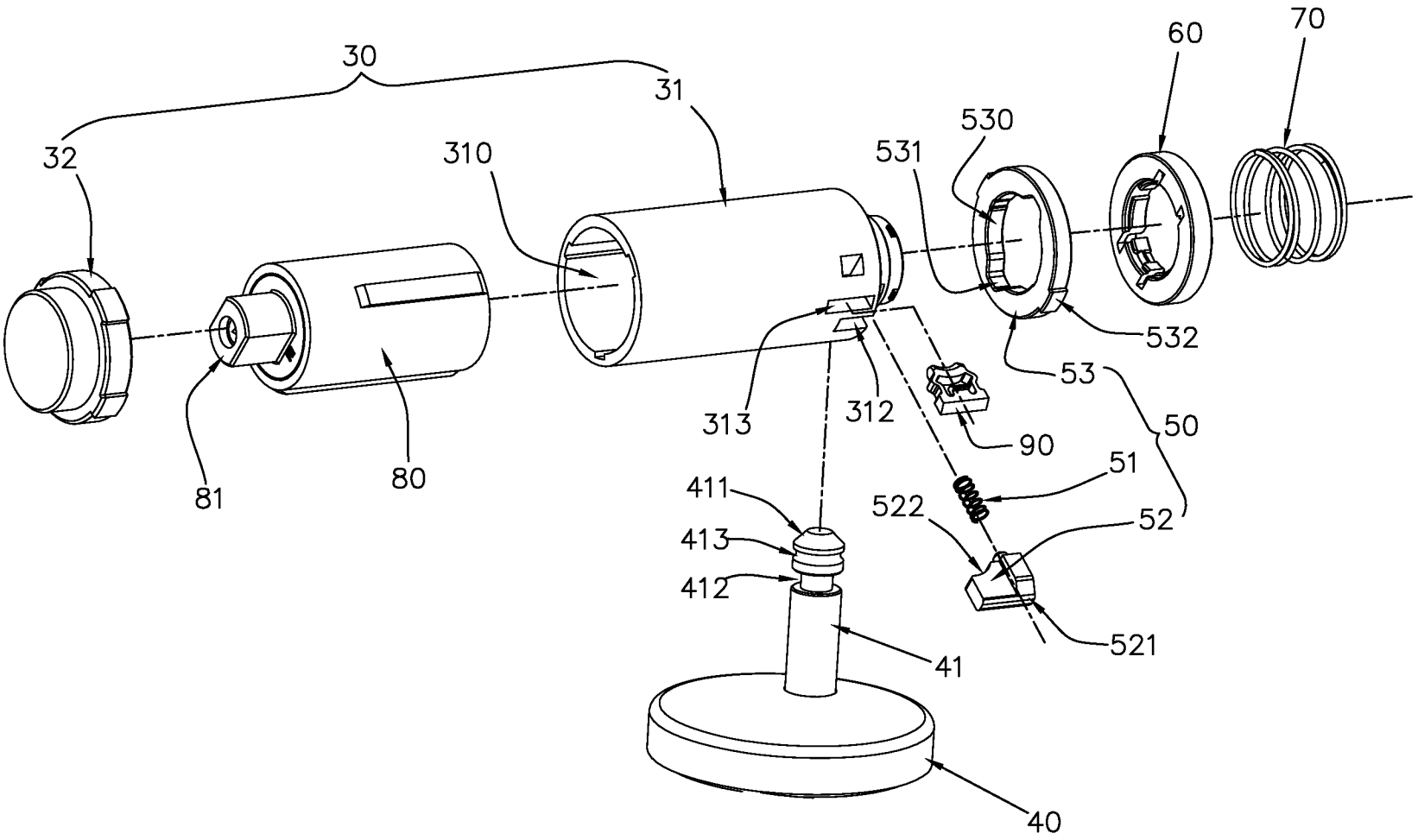
FIG. 1 is a first exploded view according to a preferred embodiment of the present invention.
Figure 2:
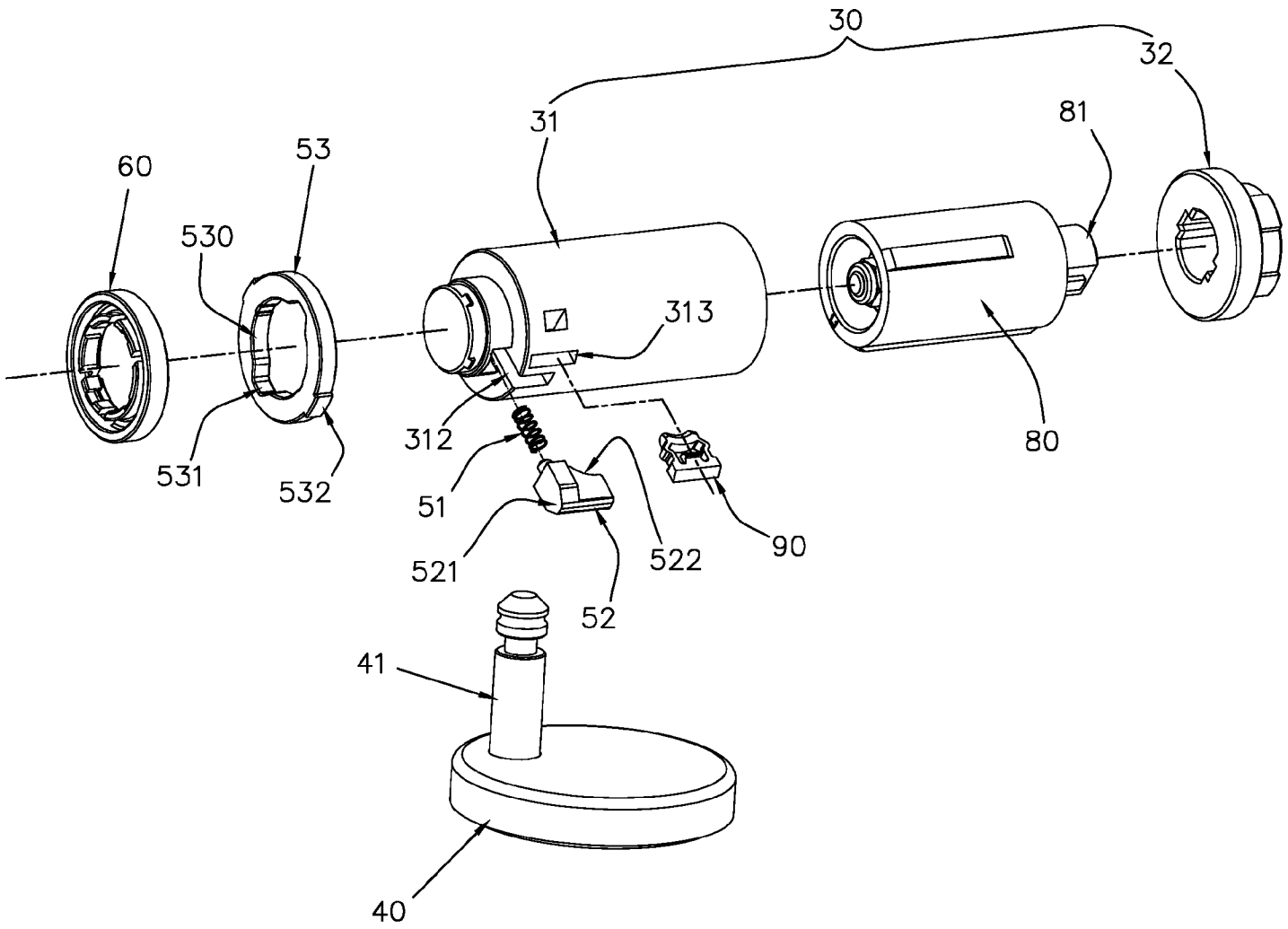
FIG. 2 is a second exploded view according to the preferred embodiment of the present invention.
Figure 3:
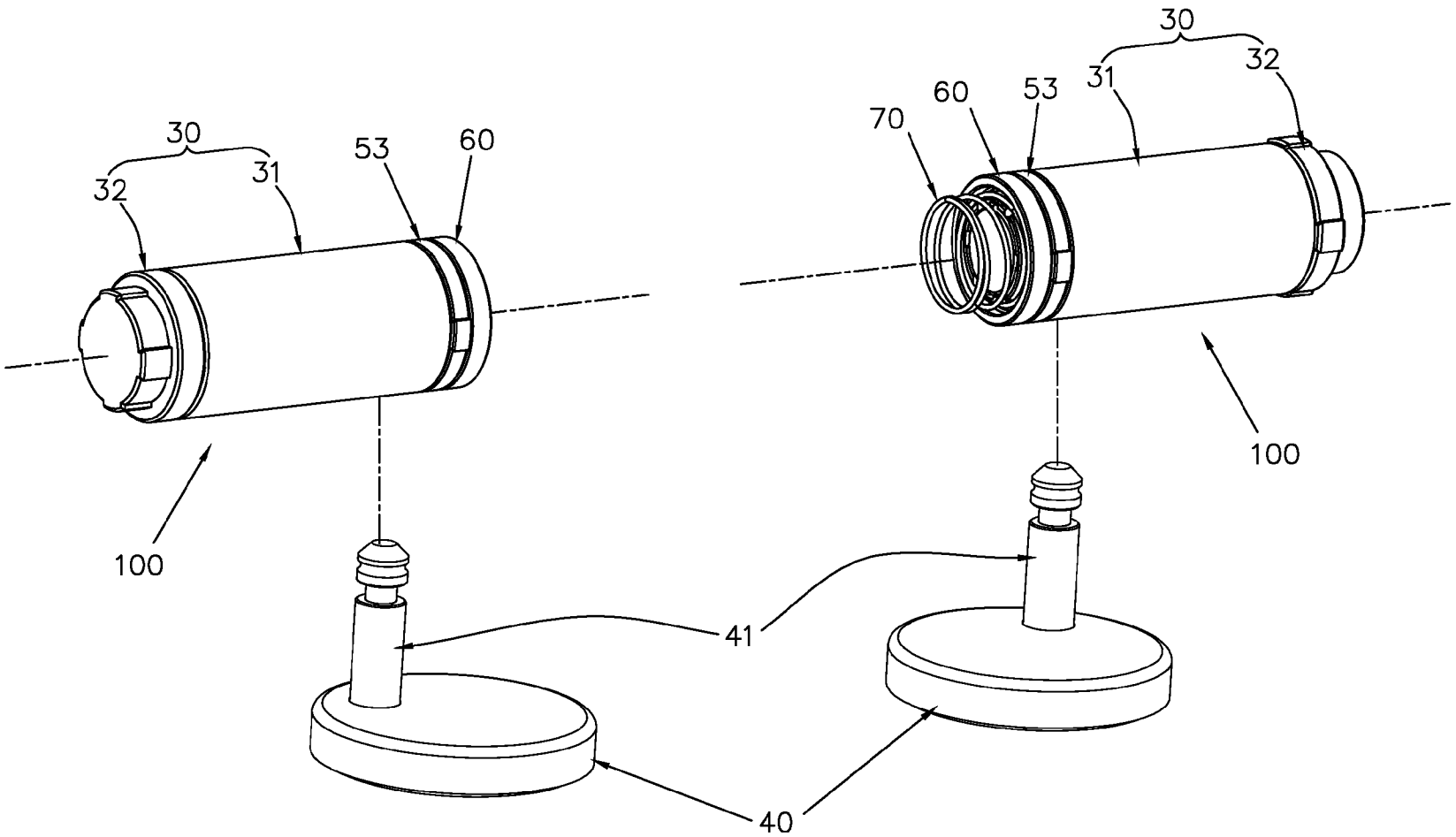
FIG. 3 is a perspective view according to the preferred embodiment of the present invention.
Figure 8:
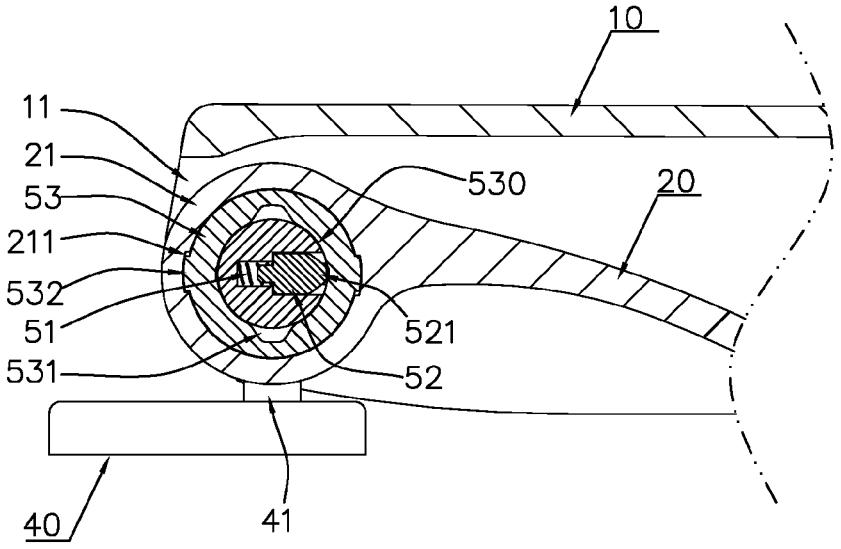
FIG. 8 is a sectional view taken along line A-A of FIG. 7.

As shown in FIG. 1 and FIG. 2, an axial inner hole 310 of the fixing axle 31 is to receive a damper 80 therein. A damper axle 81 of the damper 80 is exposed out of the axial inner hole 310 to connect with the turning member 32. The fixing axle 31 is formed with a lock hole 312 intersecting the radial pin hole 311, as shown in FIG. 6. A spring 51 is first inserted into the lock hole 312, and then a lock plate 52 is inserted. The spring 51 is held between the lock plate 52 and the fixing axle 31, such that the lock plate 52 is slidably connected in the lock hole 312. A turning ring 53 linked by the toilet seat is rotatably fitted on the fixing axle 31. An inner wall 530 of the turning ring 53 is formed with a pair of symmetrical inverted step recesses 531 corresponding in position to the pin hole 311. An outer wall of the turning ring 53 is formed with a pair of protrusions 532 to engage with engaging notches 311 formed on the inner wall of the toilet seat axle sleeve 21, as shown in FIG. 8. The inner wall 530 of the turning ring 53 holds against the outer end of the lock plate 52. An outer end of the lock plate 52 has a trapezoid protruding platform 521 to mate with the inverted step recess 531. An inner end of the lock plate 52 has a curved notch 522 to mate with an annular groove 412 of the pin 42. A top end of the pin 41 has an annular inclined surface 411. The annular inclined surface 411 can be used to press against the distal end of an elastic plate 90 to disengage from the pin hole 311, and it can be used to guide the pin 41 to insert into the pin hole 311 quickly. The fixing axle 31 is further connected with a stop ring 60 for preventing the turning ring 53 from disengagement. The spring 51, the lock plate 52, and the turning ring 53 constitute a lock control switch 50 to lock or unlock the pin 41. The pivot 30 is provided with the damper 80, the lock control switch 50 and the stop ring 60 to constitute an axial fitting assembly 100 for connecting the toilet seat cover axle sleeve 11 with the toilet seat axle sleeve 21, as shown in FIG. 3. In this invention, the fixing axle 31 is further formed with an engaging hole 313 which is disposed above the lock hole 312 and communicates with the pin hole 311. The pin 41 is formed with an annular positioning groove 413 corresponding in position to the engaging hole 313. The wall of the positioning groove 413 has a curved surface. The elastic plate 90 is engaged in the engaging hole 313 and can be positioned in the positioning groove 413. The work principle of the present invention is that when the turning ring 53 is turned 90°±3°, the inverted step recess 531 is to press against the trapezoid protruding platform 521 to disengage from the inverted step recess 531, the inner wall 530 of the turning ring 53 holds against the trapezoid protruding platform 521 at the outer end of the lock plate 52, and the curved notch 522 at the inner end of the lock plate 52 is engaged with the annular groove 412 of the pin 41, such that the pin 41 cannot be pulled out of the pin hole 311. When the turning ring 53 is turned 90°±3° reversely, the trapezoid protruding platform 521 at the outer end of the lock plate 52 is engaged in the inverted step recess 531, the curved notch 522 at the inner end of the lock plate 52 is disengaged from the annular groove 412 of the pin 41, such that the pin 41 disengages from the fixing axle 31.

As shown in FIG. 3 to FIG. 6, an axial fitting assembly 100 is first inserted into the toilet seat cover axle sleeve 11 and the toilet seat axle sleeve 21 at the right sides of the toilet seat cover 10 and the toilet seat 20. Another axial fitting assembly 100 is first fitted with a compression spring 70 and then inserted into the toilet seat axle sleeve 21 at the left side of the toilet seat 20. After that, the left axial fitting assembly 100 is axially pressed to compress the compression spring 70. The compression spring 70 axially holds against the stop ring 60. The axial fitting assembly 100 is retracted into the toilet seat axle sleeve 21. The left toilet seat axle sleeve 21 is aligned with the left toilet seat cover axle sleeve 11 of the toilet seat cover 10, by the action of the elasticity the compression spring 70, the fixing axle 31 at the end of the axial fitting assembly 10 is to connect the toilet seat axle sleeve 21 and the toilet seat cover axle sleeve 11, such that the axial fitting assembly 10 is to complete the connection and positioning of the toilet seat cover axle sleeve 11 and the toilet seat axle sleeve 21. The pin hole 311 of the fixing axle 31 is aligned with a slot 211 of the toilet seat axle sleeve 21. The slot 211 is adapted to receive the pin 41 when the toilet seat 20 is turned. As shown in FIG. 5 and FIG. 6, the pin 41 of the support 40 is inserted into the pin hole 311, and the toilet seat cover 10 and the toilet seat 20 are in a closed state.

Figure 7:
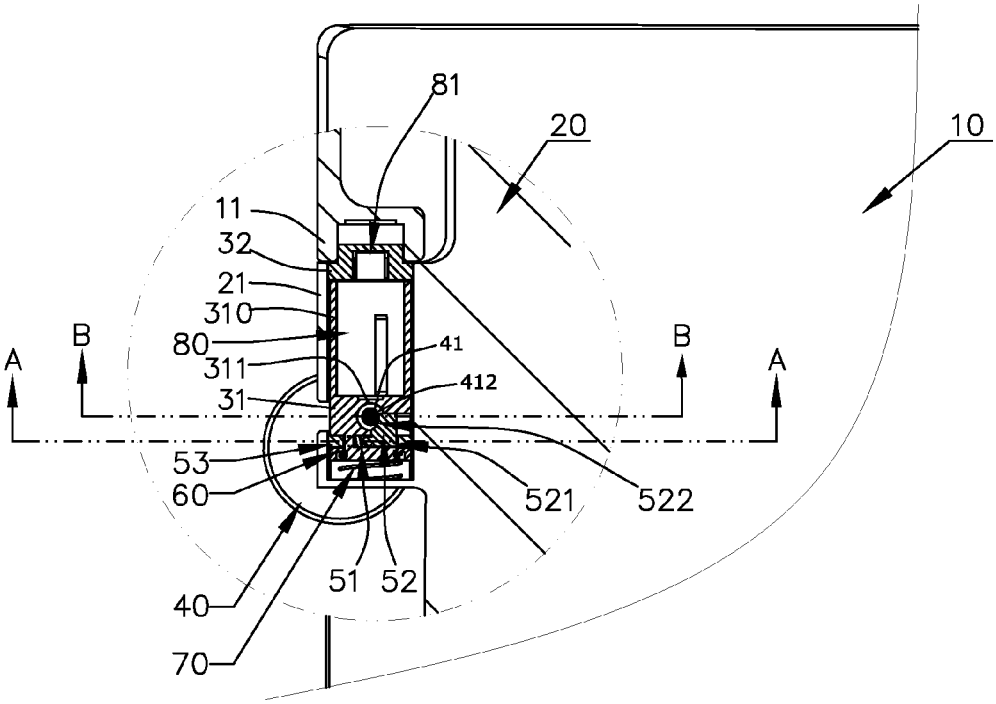
FIG. 7 is a partial sectional view showing the toilet seat mounted with the present invention in a closed state.
Figure 9:
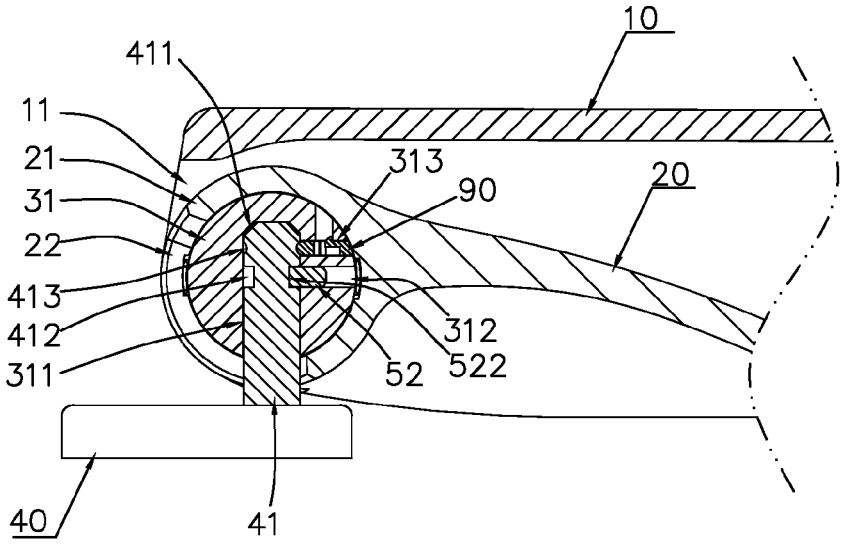
FIG. 9 is a sectional view taken along line B-B of FIG. 7.

The work principle and operation of the present invention are described in detail hereinafter. The pin 41 of the support 40 is inserted into the pin hole 311, and the toilet seat cover 10 and the toilet seat 20 are in a closed state. As shown in FIG. 7 and FIG. 9, the inner wall 530 of the turning ring 53 linked by the toilet seat axle sleeve 21 is to press against the trapezoid protruding platform 521 at the outer end of the lock plate 52. The lock plate 52 is to compress the spring 51. The curved notch 523 at the inner end of the lock plate 52 is engaged with the annular groove 412 of the pin 41, such that the pin 41 is unable to disengage from the pin hole 311 of the fixing axle 31, namely, the toilet seat cover 10 and the toilet seat 20 are secured to the support 40 to achieve connection and positioning of the toilet seat and the toilet bowl.

Figure 10:
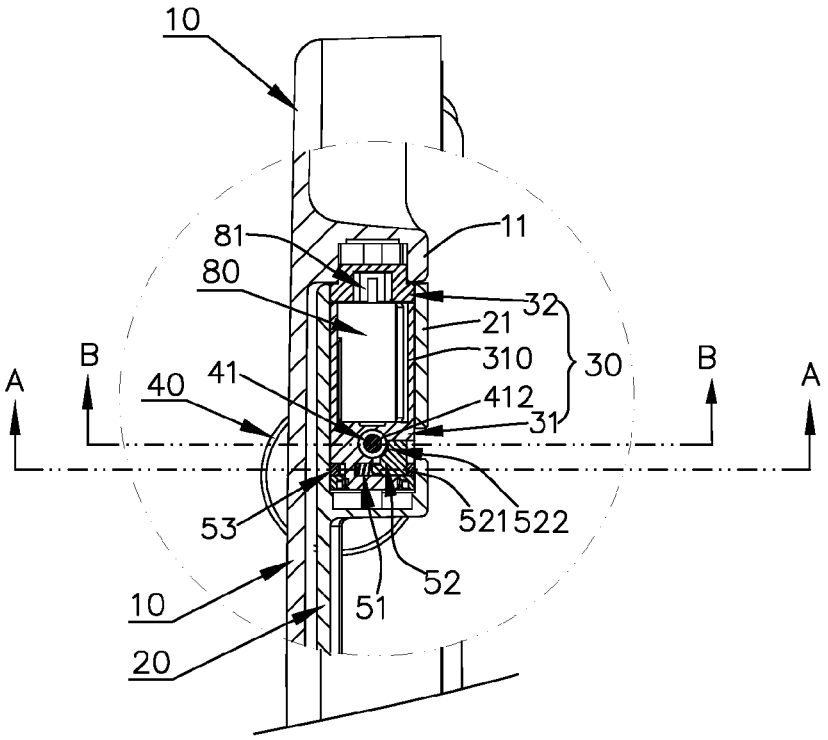
FIG. 10 is a partial sectional view showing the toilet seat mounted with the present invention in an open state.
Figure 11:
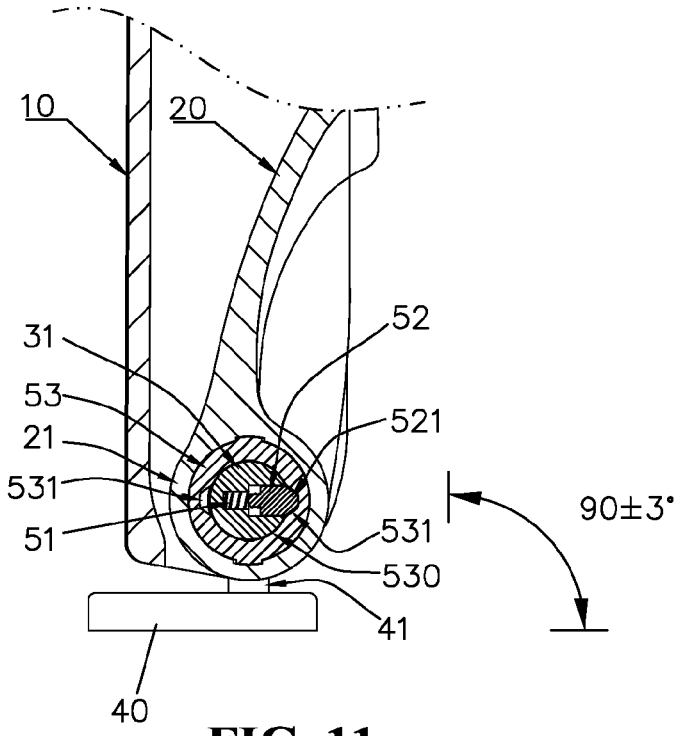
FIG. 11 is a sectional view taken along line A-A of FIG. 10.
Figure 12:
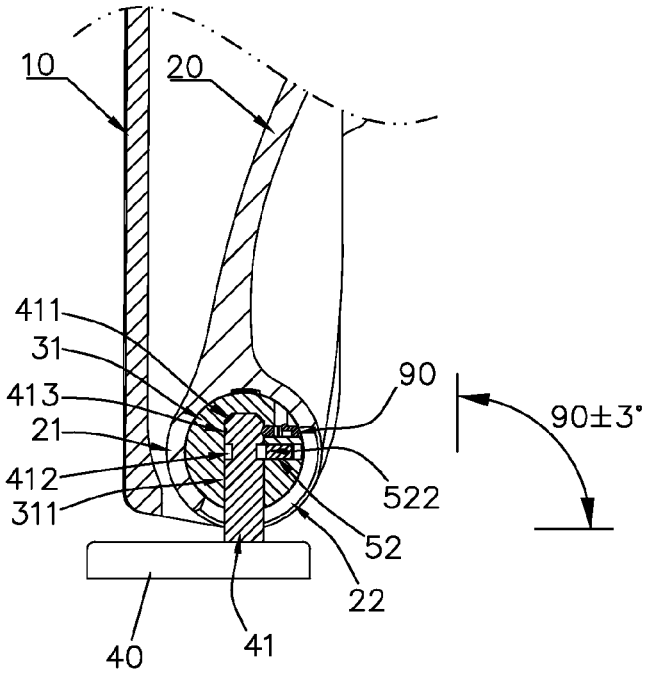
FIG. 12 is a sectional view taken along line B-B of FIG. 10.
Figure 13:
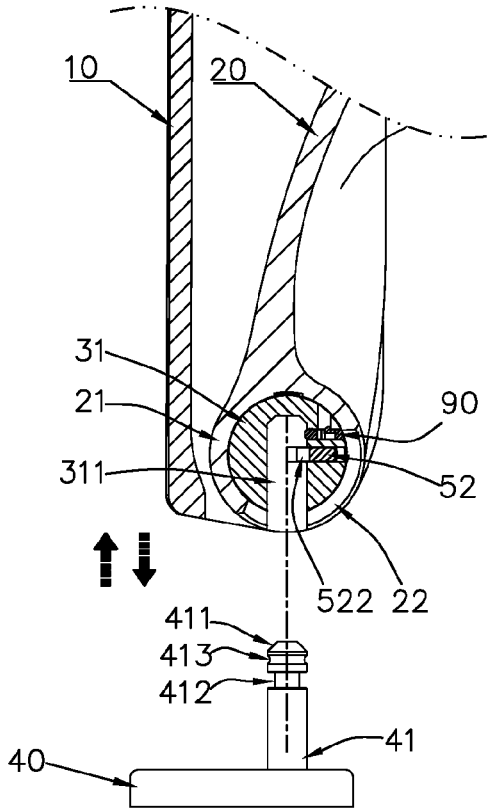
FIG. 13 is a schematic view showing that the toilet seat and the pin of support are in a separate state.

As shown in FIG. 10 to FIG. 12, the toilet seat 20 is lifted about 90±3 degrees for the toilet seat 20 in a vertical state. Under this state, the inverted step recess 531 on the inner wall 530 of the turning ring 53 linked by the toilet seat axle sleeve 21 is turned about 90±3 degrees, such that the inverted step recess 531 is turned to the trapezoid protruding platform 521 at the outer end of the lock plate 52. The inverted step recess 531 is to receive the trapezoid protruding platform 521. By the action of the elasticity of the spring 51, the lock plate 52 is pushed outward, the trapezoid protruding platform 521 is engaged in the inverted step recess 531, the curved notch 523 at the inner end of the lock plate 52 is disengaged from the annular groove 412 of the pin 41, and the curved notch 523 is retreated from the pin hole 311. As shown in FIG. 12, by applying less force to overcome the elasticity of the elastic plate 90, the distal end of the elastic plate 90 disengages from the annular positioning groove 413 of the pin 41. As shown in FIG. 13, the pin 41 is pulled out of the pin hole 311 to disengage from the fixing axle 31 to disassemble the toilet seat cover 10 and the toilet seat 20 from the support 40.

As shown in FIG. 13, when the toilet seat cover 10 and the toilet seat 20 are in a vertical state, the lock plate 52 is retreated from the pin hole 311. The pin 41 of the support 40 is aligned with the pin hole 311 to pass through the slot 211 of the toilet seat axle sleeve 21 to be inserted into the pin hole 311. The annular inclined surface 411 at the top end of the pin 41 is to press against the distal end of the elastic plate 90 to be deformed. When the annular positioning groove 413 of the pin 41 is aligned with the elastic plate 90, as shown in FIG. 12, the distal end of the elastic plate 90 is quickly snagged into the annular positioning groove 413 to sound a noise. This moment, the user can know the pin 41 is positioned in the pin hole 31.

Figure 14:
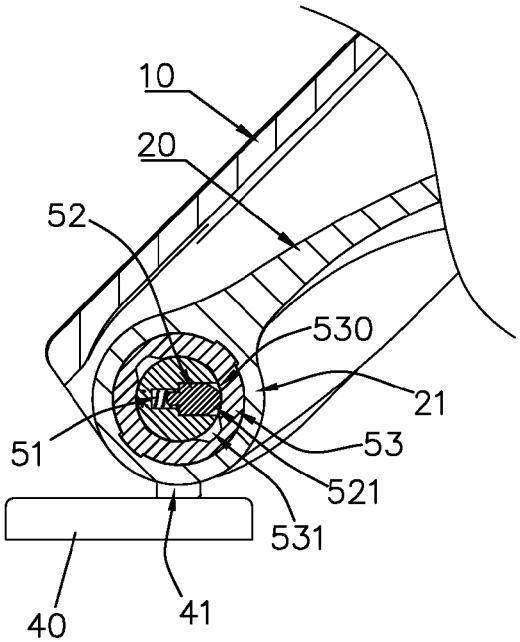
FIG. 14 is a sectional view showing the cooperation of the lock plate and the turning ring when the toilet seat is not in a vertical state.
Figure 15:
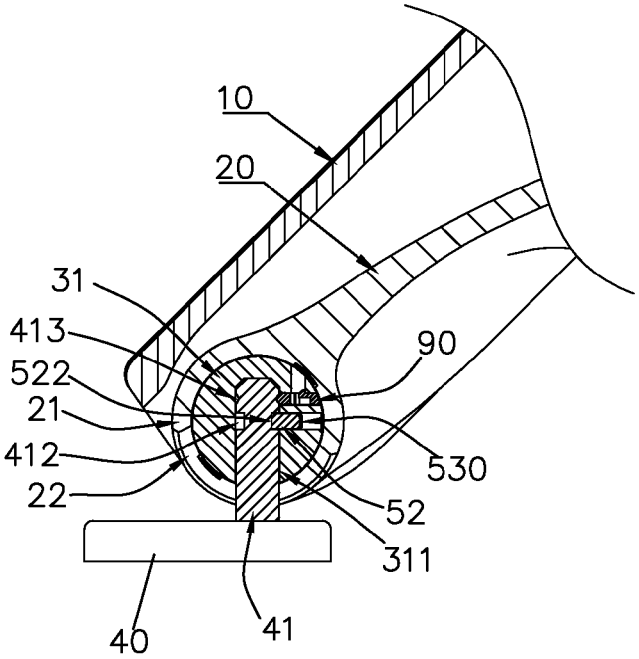
FIG. 15 is a sectional view showing the cooperation of the lock plate and the pin when the toilet seat is not in a vertical state.

As shown in FIG. 14 and FIG. 15, the turning angle of the toilet seat 20 is small than 90±3 degrees, the inner wall 530 of the turning ring 53 is to press against the trapezoid protruding platform 521 at the outer end of the lock plate 52 to limit the slide direction of the lock plate 52, such that the curved notch 523 at the inner end of the lock plate 52 is unable to disengage from the annular groove 412 of the pin 41, namely, the pin 41 is locked by the lock plate 52 so the pin 41 cannot be pulled out of the pin hole 311. The toilet seat cover 10 and the toilet seat 20 are connected to be secured on the support 40, namely, the toilet seat cannot be disengaged from the toilet bowl.

Figure 16:
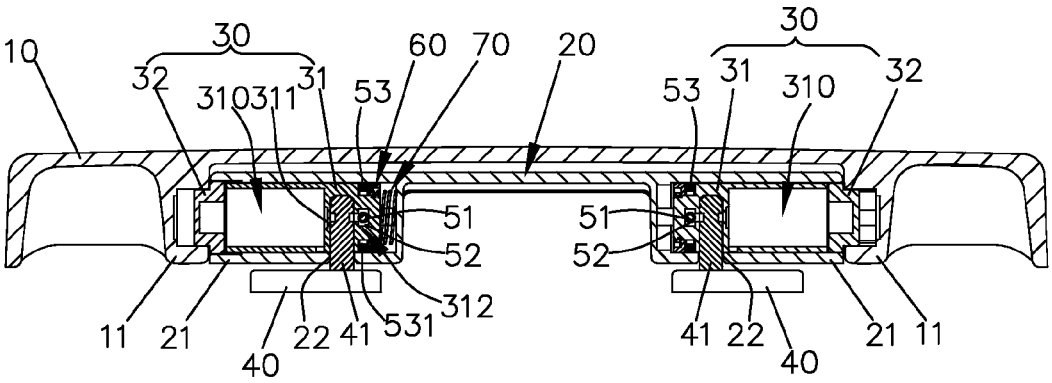
FIG. 16 is a sectional view showing the axial inner hole of the fixing axle is not provided with the damper.

As shown in FIG. 16, the axial inner hole 310 of the fixing axle 31 is not provided with the damper 80. The fixing axle 31 is adapted for the toilet seat axle sleeve 21 to pivot thereon. The turning member 32 is to connect the toilet seat cover axle sleeve 11 and the toilet seat axle sleeve 21. Without the damper 80, the fixing axle 31 and the turning member 32 constitute the pivot 30 to support the toilet seat. This provides an additional choice for the toilet seat not having a buffer function.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A vertical assembling and disassembling mechanism for a toilet seat, comprising a support fixed to a toilet bowl and a fixing axle for a toilet seat axle sleeve to pivot on the fixing axle, a pin on the support being inserted into a radial pin hole of the fixing axle;

a turning member for connecting a toilet seat cover axle sleeve with a toilet seat axle sleeve, an axial inner hole of the fixing axle being provided with a damper therein, a damper axle of the damper being exposed out of the axial inner hole to connect with the turning member;

the fixing axle being formed with a lock hole intersecting the radial pin hole, a lock plate being slidably connected in lock hole, a spring being provided between the lock plate and the fixing axle, a turning ring linked by the toilet seat being rotatably fitted on the fixing axle, an inner wall of the turning ring slidably holding against an outer end of the lock plate, an inner end of the lock plate being engaged with an annular groove of the pin, the inner wall of the turning ring being formed with a pair of symmetrical inverted step recesses corresponding in position to the pin hole;

wherein, when the turning ring is turned about 90±3 degrees, the outer end of the lock plate is engaged in the inverted step recess and the inner end of the lock plate is disengaged from the annular groove of the pin.

2. The vertical assembling and disassembling mechanism for a toilet seat as claimed in claim 1, wherein the outer end of the lock plate has a trapezoid protruding platform to mate with the inverted step recess, when the turning ring is turned, the inverted step recess is able to press against the trapezoid protruding platform to disengage from the inverted step recess.

3. The vertical assembling and disassembling mechanism for a toilet seat as claimed in claim 1, wherein the inner end of the lock plate has a curved notch to mate with the annular groove of the pin.

4. The vertical assembling and disassembling mechanism for a toilet seat as claimed in claim 1, wherein an outer wall of the turning ring is formed with a pair of protrusions to engage with engaging notches formed on an inner wall of the toilet seat axle sleeve.

5. The vertical assembling and disassembling mechanism for a toilet seat as claimed in claim 1, wherein the fixing axle is further connected with a stop ring for preventing the turning ring from disengagement.

6. The vertical assembling and disassembling mechanism for a toilet seat as claimed in claim 5, further comprising a compression spring, the compression spring axially holding against the stop ring for the turning member to be positioned between the toilet seat cover axle sleeve and the toilet seat axle sleeve.

7. The vertical assembling and disassembling mechanism for a toilet seat as claimed in claim 6, wherein the compression spring is inserted in the toilet seat axle sleeve and held between the stop ring and the toilet seat axle sleeve.

8. The vertical assembling and disassembling mechanism for a toilet seat as claimed in claim 1, wherein the fixing axle is further formed with an engaging hole which is disposed above the lock hole and communicates with the pin hole, the pin is formed with an annular positioning groove corresponding in position to the engaging hole, and an elastic plate is engaged in the engaging hole and positioned in the positioning groove.

9. The vertical assembling and disassembling mechanism for a toilet seat as claimed in claim 8, wherein a wall of the positioning groove has a curved surface.

10. The vertical assembling and disassembling mechanism for a toilet seat as claimed in claim 1 or 8, wherein a top end of the pin has an annular inclined surface.

* * * * *